US007446635B2

(12) United States Patent
Stanke et al.

(10) Patent No.: US 7,446,635 B2
(45) Date of Patent: Nov. 4, 2008

(54) COMBINATION OF TWO ELECTROMAGNETIC SWITCHING DEVICES

(75) Inventors: Stephan Stanke, Rheinbach (DE); Frank Friederiszick, Niederkassel (DE)

(73) Assignee: Moeller GmbH, Bonn (DE)

( * ) Notice: Subject to any disclaimer, the term of this patent is extended or adjusted under 35 U.S.C. 154(b) by 6 days.

(21) Appl. No.: 10/578,115

(22) PCT Filed: Nov. 2, 2004

(86) PCT No.: PCT/EP2004/012516

§ 371 (c)(1),
(2), (4) Date: May 8, 2007

(87) PCT Pub. No.: WO2005/043685

PCT Pub. Date: May 12, 2005

(65) Prior Publication Data

US 2007/0290778 A1 Dec. 20, 2007

(30) Foreign Application Priority Data

Nov. 3, 2003 (DE) ..... 103 51 123

(51) Int. Cl.
*H01H 9/20* (2006.01)

(52) U.S. Cl. ..... 335/160; 335/159; 335/202; 439/172; 200/50.32

(58) Field of Classification Search ..... 335/159, 335/160, 161, 202; 439/166–175, 511; 200/50.32, 200/284
See application file for complete search history.

(56) References Cited

U.S. PATENT DOCUMENTS

| | | | | |
|---|---|---|---|---|
| 4,626,052 A | | 12/1986 | Rumble | 339/31 |
| 4,954,798 A | * | 9/1990 | Kasahara et al. | 335/161 |
| 6,233,167 B1 | | 5/2001 | Chen et al. | 363/146 |
| 6,790,058 B2 | | 9/2004 | Schlieber et al. | |
| 6,848,951 B1 | | 2/2005 | Bechaz et al. | 439/716 |
| 6,888,077 B2 | * | 5/2005 | Garcia et al. | 200/50.32 |

FOREIGN PATENT DOCUMENTS

| | | |
|---|---|---|
| DE | 195 15 923 | 11/1996 |
| DE | 19515923 | 11/1996 |
| DE | 19713857 | 4/1998 |
| DE | 10005818 | 8/2001 |
| DE | 10023966 | 11/2001 |
| EP | 0 918 385 A1 | 5/1999 |
| EP | 0918385 | 5/1999 |
| ES | 2 076 075 | 10/1995 |
| ES | 2076075 | 10/1995 |

OTHER PUBLICATIONS

Search Report of PCT/EP2004/012516, May 1, 2006.

* cited by examiner

*Primary Examiner*—Ramon M Barrera
(74) *Attorney, Agent, or Firm*—Darby & Darby

(57) ABSTRACT

A combination of at least two electromagnetic switching devices, each of which is provided with a plug-in connector socket and can be fixed side by side on a support in a stationary position in relation to one another and can be connected to form electrical contact by means of a connection unit. The connection unit includes an electrical conductor connection and a plug-in connector system. The conductor connection is encased by a housing of the connection unit and the plug-in connector system is encased by the lateral faces of the connection unit that face the switching devices. The plug-in connector system is configured to be displaced on the lateral face of the connection unit towards the lateral face of the neighbouring device in the connection unit housing.

9 Claims, 3 Drawing Sheets

COMBINATION OF TWO ELECTROMAGNETIC SWITCHING DEVICES

CROSS REFERENCE TO PRIOR APPLICATIONS

This application is a U.S. National Phase of International Patent Application No. PCT/EP2004/012516, filed Nov. 2, 2004, which claims priority to German Patent Application No. DE 103 51 123, filed Nov. 3, 2003, the entire disclosure of which is incorporated by reference herein. The International Application was published in German on May 12, 2005 as WO 2005/043685.

FIELD OF THE INVENTION

The present invention relates to a device combination including at least two electromagnetic switching devices.

BACKGROUND

Already known are electrical connectors (wiring bridges) between devices that are mounted on a device mounting support (for example, on a mounting rail or on a busbar adapter), the two devices being electrically connected to each other via the electrical connector. Connectors of this type are members holding fixedly disposed pin contacts which cooperate with corresponding contact receptacles on the devices. Electrical connection is achieved by the connector establishing electrical contact between the devices when moving said devices toward each other. In order to bring the devices into contact, at least one device must be slidably mounted on the device mounting support.

Such types of equipment having devices (sliding carriages or the like) that are slidably mounted on a device mounting support are known, for example, from the following publications: DE 100 05 818 A1, ES 2076075 A2 or DE 195 15 923 C2.

The aforementioned devices have the disadvantage that the sliding mechanism constitutes a complex additional part. Secondly, such an arrangement requires at least one switching device to be removed, or at least displaced, in order to separate the switching units from each other.

SUMMARY OF THE INVENTION

An object of the present invention is to provide a device combination that does not need a complex sliding mechanism. Preferably, the devices should be mounted on the device mounting support in a fixed position, while still allowing electrical contact between the devices to be established in a simple manner.

According to the present invention the plug-in connection system is designed such that it is fixed on a first lateral side of the connector, and on a second lateral side thereof, it is displaceable within the connector housing toward the lateral side of the adjacent device.

The displaceable device is composed of a slider formed in the upper side of the connector and holding the displaceable plug-in connection system. The slider preferably rides within a tongue and groove guide formed in the connector housing. The guide may, for example, take the form of a dovetail guide. The slider should be operable manually. To this end, it is preferred for the slider to have an operating handle mounted thereon. The displaceability makes it possible to bridge a distance of up to 20 mm.

An advantage of the present invention is that the connector bridges the space between the devices without having to displace or remove the adjacent switching devices for purposes of connection and disconnection. The devices to be connected can each be mounted on one DIN rail, respectively. They can also be mounted on a busbar adapter on separate mounting rails disposed on the adapter. The devices may also be individually or collectively connected to other electronic devices, for example, to a bus connection module, via additional electrical connectors.

Using the connector according to the present invention involves a fixed allocation of contacts between the switching devices, which prevents incorrect assembly resulting from exchanging conductors.

Advantageous embodiments include the following further features, employed either singly or in combination in addition to the basic invention.

The plug-in connection systems on the connector (on the lateral sides of the connector) preferably take the form of male connectors. Accordingly, female connector receptacles are provided on the switching devices. As a rule, the plug-in connection systems should be 3-pole type.

Because of the displaceability of the plug-in connection system, the conductor connection is designed to be able to follow the displacement. To this end, the conductor connection may preferably take the form of a flexible conductor, or else in the form of telescopic rail, or the like. When choosing a flexible conductor, the conductor should take the form of an insulated, highly flexible copper round braid.

At the connector receptacles of the switching devices, there are provided clamping screws for securely locking the plug-in connection systems. Clamping of the pins is particularly important in order to prevent the plug-in connection from loosening due to vibrations during the switching operations in the switching devices.

The device mounting support may preferably be formed by a busbar adapter or by one mounting rail for each unit.

To increase mechanical stability, snap-in locking elements (such as cams) may be provided on the connector housing, said snap-in locking elements lockingly engaging with associated openings on at least one of the switching devices.

The device mounting support is formed by a busbar adapter or by one mounting rail for each unit.

BRIEF DESCRIPTION OF THE DRAWINGS

A specific embodiment of the present invention is shown in the figures. Specifically.

DETAILED DESCRIPTION

Figure 1:
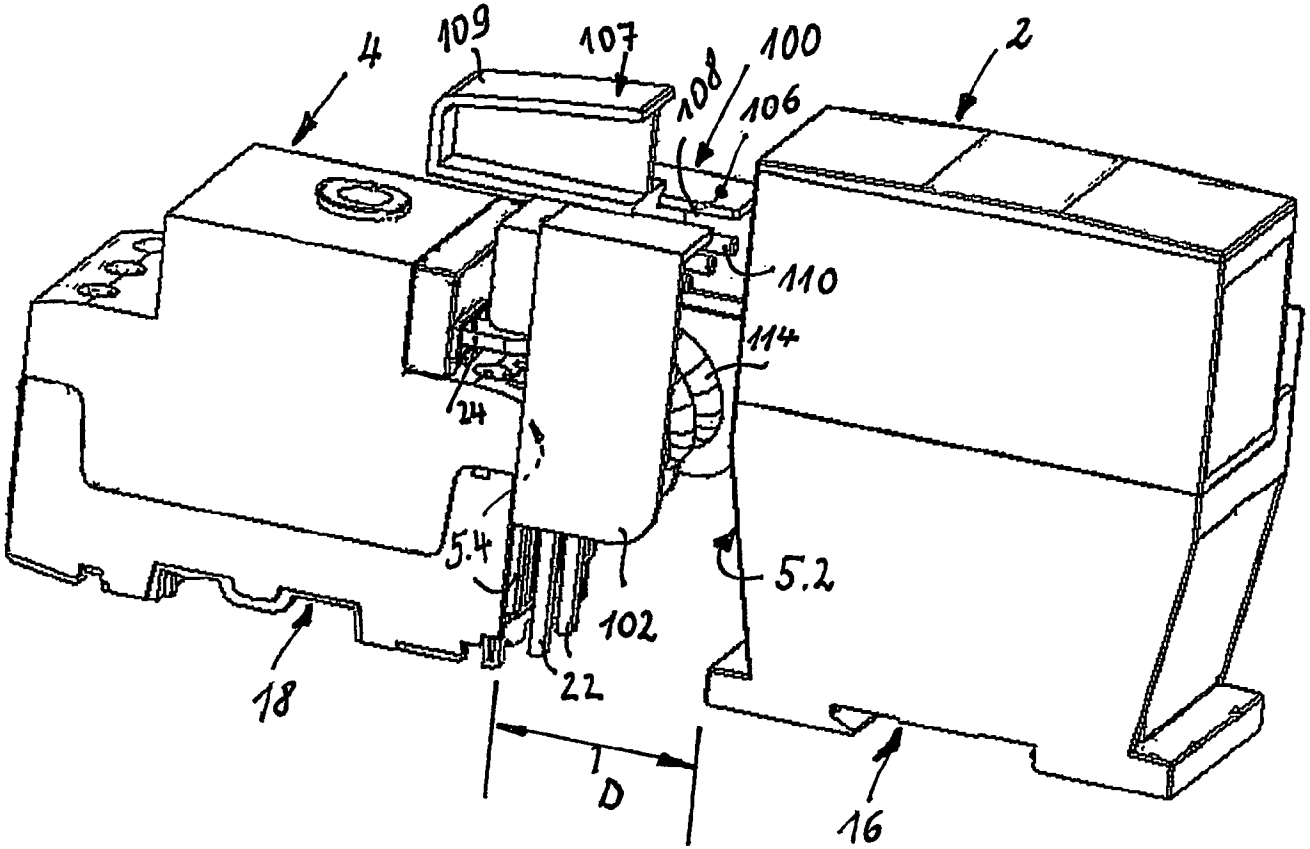
FIG. 1 is a perspective view showing two switching devices together with a connector.
Figure 2:
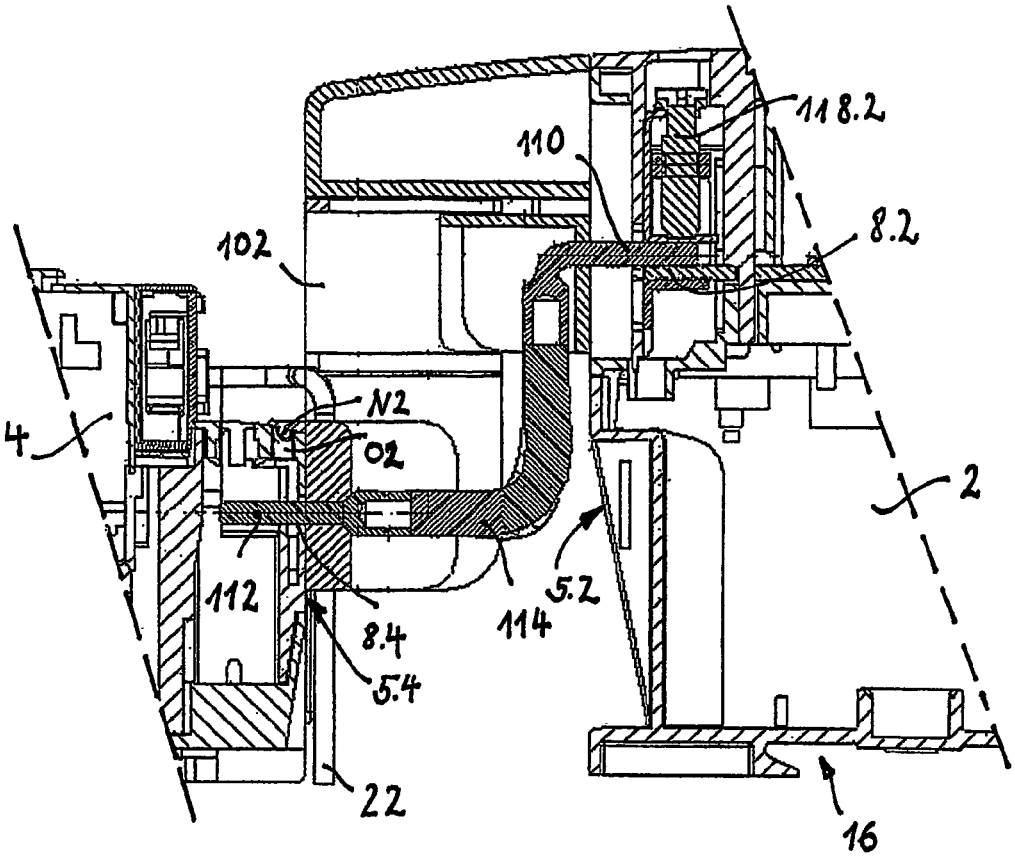
FIG. 2 is a cross-sectional view showing the connector in a position connecting the switching devices.
Figure 3A:
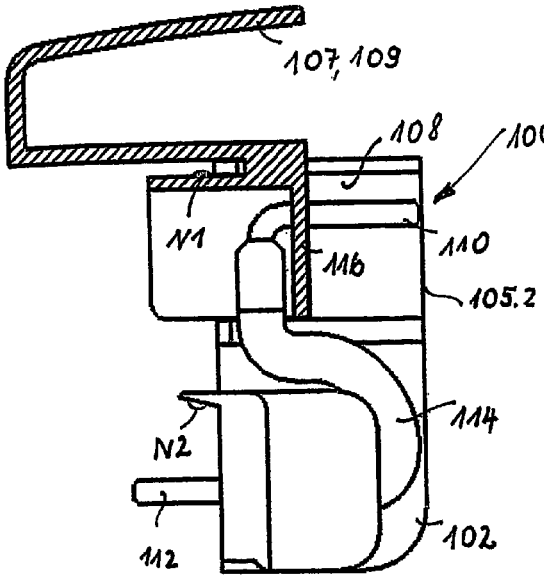
FIGS. 3A and 3B show the connector in two positions.
Figure 3B:
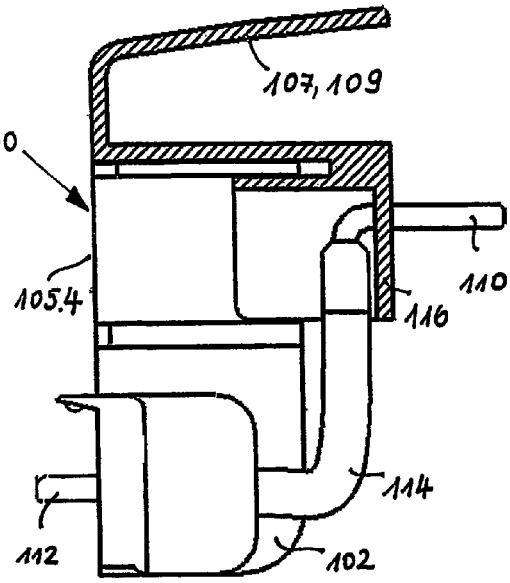

In FIGS. 1 and 2, two switching devices 2, 4 are shown together with a connector 100; FIG. 2 being a cross-sectional view through the connector connecting the main current paths between the switching devices.

Switching devices 2, 4 are mounted via their busbar receiving means 16, 18 on two mounting rails (not shown) such that they are spaced apart by a distance D. The switching devices provided may, for example, be a motor starter and a contactor. The switching devices may also be connected to other devices via additional electrical connections 22, 24. The housing of the connector may be provided with openings for receiving the additional electrical connections 22, 24, whereas otherwise the lateral sides (105.2, 105.4) of the connector contact the mutually facing lateral sides (5.2, 5.4) of the adjacent switching devices.

Contained in the terminal compartments of the switching devices are (female) connector receptacles 8.2., 8.4, which are accessible from the lateral sides 5.2, 5.4 of the switching devices. The connector receptacles receive the pins 110, 112 of connector 100. The plug-in connection systems are 3-pole type; FIG. 1 showing two of three associated flexible conductors 114 and two of three associated connector pins 110. In the cross-sectional drawings, the plug-in connection systems, male connectors 110, 112 and flexible conductors 114, are located behind each other, so that their number cannot be seen. The male connectors can take the form of pin contacts, wire end ferrules, or contact pieces. The flexible conductors have appropriate lengths and cross-sectional areas, which may be suitably selected by those skilled in the art for this purpose.

Connector 100 is formed by a housing 102 made of insulating material and holding fixedly disposed connector pins 112 on one lateral side thereof. In upper side 106 of the connector, the displaceable device takes the form of a slider 107. Slider 107 holds the displaceable plug-in connection system and rides in a tongue and groove guide 108. Slider 107 can be operated manually using operating handle 109.

In FIG. 1, the connector is in contact with switching device 4 (to the left) and out of contact with second switching device 2. In this installed position, slider 107 is in a position in which it has been moved to the left within housing 102. In FIG. 2, the connector is in contact with both switching devices (the slider is located to the right). In order to provide a first electrical connection, male connectors 112 are inserted into the connector receptacles of the first switching device and tightly clamped with clamping screws. The mechanical stability is increased during installation by the fact that connector housing 102 can snap into openings on the first switching device by means of locking cam N2. Snap-in opening O2 and locking cam N2 are indicated in FIG. 2.

The clamping means mentioned earlier can be seen on second switching device 2 in the form of clamping screws 118.2. To allow the clamping screws to be screwed down, the housing 102 of the connector is designed such that the clamping screws on the switching devices remain accessible from above using a screwdriver, independently of the position of slider 107. After completion of the clamping operation on first switching device 4, the slider is moved to the right (see FIG. 2), with second switching device 2 being in a fixed position on a mounting rail or a busbar adapter, and the clamping screws 118.2 in the second switching device are tightened.

Figure 4A:
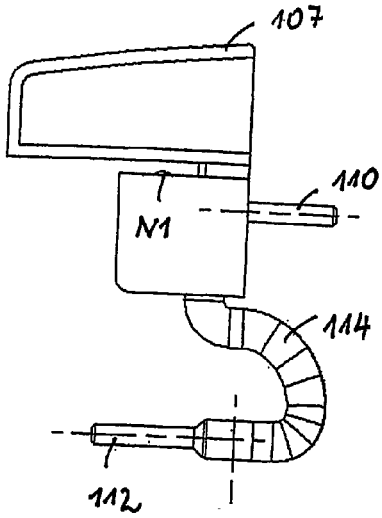
FIGS. 4A and 4B depict the connector in two positions, without showing the connector housing.
Figure 4B:
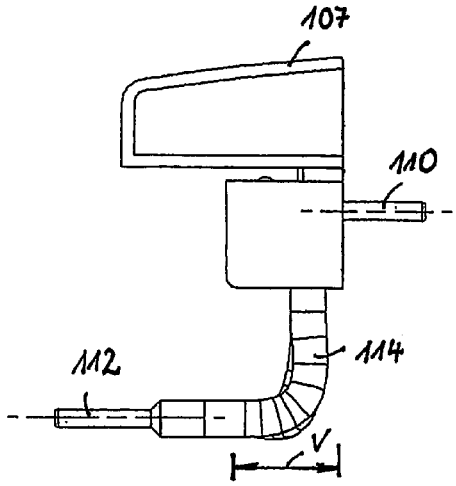

FIGS. 3A through 4B show slider 107 of connector 100 in two positions; FIGS. 4A and 4B illustrating the connector without connector housing. In FIG. 4B, the distance of displacement is denoted by V. Displacement distances may typically range from 8 to 20 mm. This distance is bridged by flexible conductor 114. When the connector is in the connecting position, the slider is locked to connector housing 102, for which purpose a locking cam N1 is provided.

In addition, insulating partitions may be disposed between the flexible conductors in the housing of the connector.

In order to supplement the description and make it complete, a list of reference numerals is provided below.

What is claimed is:

1. A device combination comprising:

a device mounting support;

at least two electromagnetic switching devices mountable adjacent and in fixed position relative to each other on the device mounting support, the switching devices each having a connector receptacle;

a connector having an upper side and two lateral connector sides and configured to pluggably electrically connect the at least two switching devices to each other, the connector including a flexible electrical conductor disposed in a connector housing and a plug-in connection system disposed on the lateral connector sides facing the respective adjacent switching devices, wherein the plug-in connection system is configured to be displaceable within the connector housing on one lateral connector side and facing toward a respective lateral side of the adjacent switching device, and wherein the connector includes a slider formed in the upper side of the connector and holding the displaceable plug-in connection system.

2. The device combination as recited in claim 1, wherein the connector housing includes a tongue and groove guide and wherein the slider rides within the tongue and groove guide.

3. The device combination as recited in claim 1, wherein the slider includes an operating handle for operating the slider.

4. The device combination as recited in claim 1, wherein the plug-in connection system on the connector includes male connectors.

5. The device combination as recited in claim 1, wherein the flexible conductor is a copper round braid.

6. The device combination as recited in claim 1, wherein the conductor connection includes a telescopic rail.

7. The device combination as recited in claim 1. wherein the connector receptacles includes clamping screws configured to lock the respective plug-in connection system in place.

8. The device combination as recited in claim 1, wherein the connector housing includes snap-in locking elements lockingly engaging with associated openings on at least one of the switching devices.

9. The device combination as recited in claim 1, wherein the device mounting support is formed by at least one of a mounting rail for each unit and a busbar adapter.

* * * * *